United States Patent [19]

Marriage

[11] Patent Number: 5,062,768

[45] Date of Patent: Nov. 5, 1991

[54] COOLED TURBOMACHINERY COMPONENTS

[75] Inventor: Peter V. Marriage, Derby, England

[73] Assignee: Rolls-Royce plc, London, England

[21] Appl. No.: 693,014

[22] Filed: Apr. 29, 1991

Related U.S. Application Data

[63] Continuation of Ser. No. 450,068, Dec. 13, 1989, abandoned.

[30] Foreign Application Priority Data

Dec. 23, 1988 [GB] United Kingdom ..... 8830152

[51] Int. Cl.[5] ..... F01D 5/18

[52] U.S. Cl. ..... 416/97 R; 29/889.721

[58] Field of Search ..... 416/96 R, 97 R; 415/115, 116; 29/889.721; 408/1 R

[56] References Cited

U.S. PATENT DOCUMENTS

| | | | |
|---|---|---|---|
| 3,688,833 | 9/1972 | Bykov et al. | 416/97 R |
| 3,819,295 | 6/1974 | Hauser et al. | 416/97 R |
| 3,934,322 | 1/1976 | Hauser | 416/97 R |
| 4,221,539 | 9/1980 | Corrigan | 416/97 A |
| 4,669,957 | 6/1987 | Phillips et al. | 415/115 |
| 4,672,727 | 6/1987 | Field | 416/97 R |
| 4,762,464 | 8/1988 | Vertz et al. | 416/97 R |

FOREIGN PATENT DOCUMENTS

| | | | |
|---|---|---|---|
| 51202 | 3/1983 | Japan | 416/97 R |
| 1348480 | 7/1970 | United Kingdom . | |

*Primary Examiner*—John T. Kwon

*Attorney, Agent, or Firm*—Cushman, Darby & Cushman

[57] ABSTRACT

An aerofoil for a gas turbine engine turbine rotor blade or stator vane is subject to film cooling by multiple rows of small cooling air exit apertures in the exterior surface of the blade or vane. Each exit aperture is supplied with cooling air through at least two holes extending from the aperture through the wall of the blade or vane to interior chambers or passages. The holes are mutually intersecting and their intersection forms the exit apertures and defines a flow constriction for controlling the flow rate of cooling air through the holes and out of the aperture. If the holes' centerlines intersect behind the plane of the exterior surface by an optional distance, the flow constriction is spaced apart from the exit aperture and is within the wall thickness, the exit aperture being enlarged. These film cooling hole configurations reduce the liability of the holes to block up due to contamination by environmental debris.

13 Claims, 3 Drawing Sheets

COOLED TURBOMACHINERY COMPONENTS

This is a continuation of application Ser. No. 07/450,068 filed on Dec. 13, 1989, which was abandoned.

The present invention relates to the cooling of components subject to the impingement of hot combustion gases in gas turbine engines, or similar turbomachines, the coolant being supplied to the interior of the components and exiting the components through small holes to film-cool the surfaces of the components. In particular, it relates to measures capable of reducing the likelihood of blockage of such holes by environmental debris entrained in the flow of coolant.

Typical examples of such components are air-cooled nozzle guide vanes and high pressure turbine rotor blades, which are situated directly downstream of a gas turbine eninge's combustion chambers. The film cooling holes are arranged in spanwise rows along the flanks of the aerofoil portions of the blades or vanes so that the streams of cooling air emerging from the holes onto the external surface can collectively protect it from direct contact with the hot gases and carry heat away by merging together to form a more-or-less continuous film of cooling air flowing next to the surface. The process of merging of the individual streams can be aided by elongating the apertures in the external surface in the spanwise direction (i.e. transverse of the hot gas flow over the aerofoils) so as to encourage the streams of cooling air to fan out towards each other.

One problem with operation of engines containing such blades and vanes is that the film cooling holes have been subject to blockage by dust in middle eastern countries. Because of the high temperatures at which these components operate, small dust particles which strike the edges of the holes, due to vorticity of the air flow through or over the holes, become slightly plastic and stick to the edges; this accretion process can continue over many hours' service until blockage occurs. Blockage can occur either internally of the blade at the film hole inlets, or on the outside of the blade at their outlets, but is most serious at their inlets. It can be combatted to some extent by enlarging the holes at their entries and/or outlets (e.g., as by the elongation of the outlet apertures mentioned previously) so that they take longer to block up. At least with respect to the inlets of the film holes, larger entry areas also reduce vorticity in the cooling air, which further reduces dust accretion.

A further problem arises if such enlargement of entry and exit apertures is undertaken, in that production of such film holes involves complex and expensive machining techniques.

The main objects of the invention are therefore to provide novel configurations of film cooling holes which ease the situation with regard to both blockage by dust accretion and difficulty of production of the holes.

According to the present invention, there is provided for use in turbomachinery or the like, a fluid-cooled component subject to heating by hot gases, the component having wall means defining an exterior surface and at least one interior chamber suppliable with the coolant, the exterior surface having a plurality of small exit apertures therein connected to the interior chamber by holes extending through the wall means, whereby coolant from the at least one interior chamber exits from said apertures onto the exterior surface for film-cooling of the same, each said aperture being connected to the interior chamber by at least two mutually intersecting holes whose exterior ends form said aperture and whose intersection defines a flow constriction for controlling the flow rate of coolant through said holes and out of said aperture.

In the case of air-cooled turbine blades or vanes in gas turbine engines, the above film cooling hole configuration is particularly useful for reducing the previously mentioned blockage of the holes by environmental debris entrained in the cooling air, in that at the least, as compared with a configuration involving an exit aperture fed by a single hole, the provision of two or more holes feeding a single aperture provides an increased area for egress of cooling air from the interior chamber without substantially increased flow rates out of it, this increased internal hole area therefore taking longer to block up. At the same time, the individual holes, if cylindrical throughout, are easy to produce.

The preferred number of mutually intersecting holes is two or three.

In the disclosed embodiments of the invention, the longitudinal centerlines of the intersecting holes intersect each other at a common point in order to best define the flow constriction. The centerlines may intersect in the plane of the exterior surface, in which case the exit aperture coincides with and defines the flow constriction. Alternatively, the centerlines may intersect behind the plane of the exterior surface, in which case the flow constriction is spaced apart from the exit aperture, being within the wall means.

Though in all embodiments of the invention the holes must differ in orientation in order to intersect, in some of the disclosed embodiments of the invention, each hole has substantially similar obliquity with respect to the exterior surface of the wall means, while in other embodiments the holes have unequal obliquities with respect to the exterior surface.

For ease of production, we prefer that the longitudinal centerlines of the holes occupy a single plane, and for some purposes it may be advantageous for this plane to be obliquely oriented with respect to the exterior surface.

In particular, the air cooled component may comprise an air-cooled turbine blade or vane for a gas turbine engine.

Exemplary embodiments of the invention will now be described with reference to the accompanying drawings, in which:

FIGS. 4A to 6A and 4B to 6B are similar respective views showing alternative film cooling hole configurations in accordance with the invention.

Figure 1:
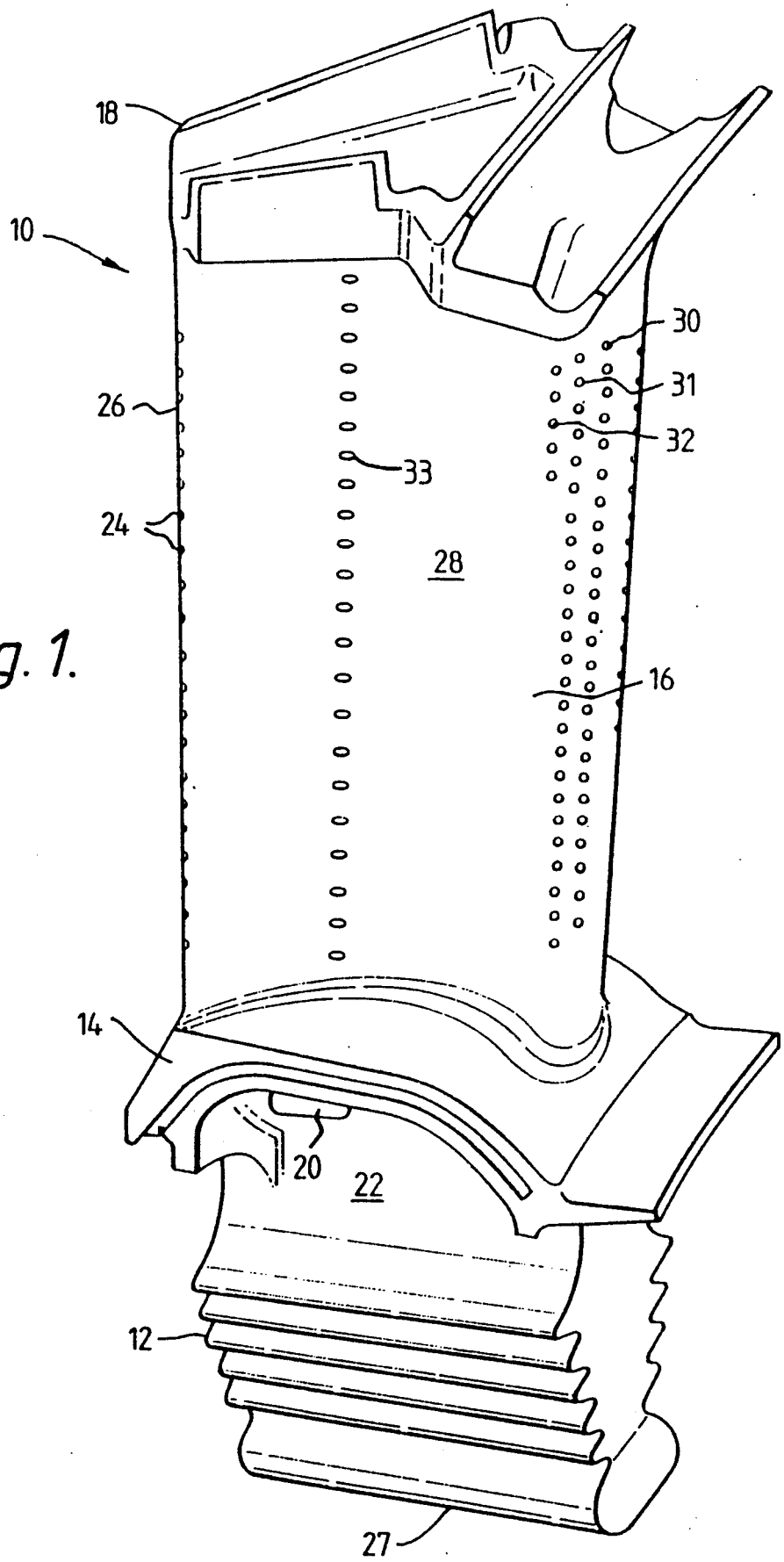
FIG. 1 is a perspective view of a known high pressure turbine rotor blade provided with film cooling holes.

Referring first to the complete turbine blade 10 shown in FIG. 1, it comprises a root portion 12, having a so-called "fir-tree" sectional shape which locates in a correspondingly shaped slot in the periphery of a turbine rotor disc (not shown); a radially inner platform 14, which abuts the platforms of neighbouring blades to help define a gas passage inner wall for the turbine; an aerofoil 16, which extracts power from the gas flow past it; and an outer shroud portion 18 which again cooperates with its neighbours to help define the outer wall of the turbine's gas passage. Although described in relation to integrally shrouded blades, the invention is of course equally applicable to unshrouded blades.

The interior of the aerofoil 16 contains a chordwise succession of substantially mutually parallel cooling air passages (not shown, but see, e.g., our U.S. Pat. No. 4,940,388 for exemplary details), which passages extend spanwise of the aerofoil. One or more of the passages are connected to a cooling air entry port 20 provided in the side face of an upper root shank portion 22 just below the underside of inner platform 14. This receives low pressure cooling air, which cools the aerofoil 16 by taking heat from the internal surface of the aerofoil as it flows through the internal passage and out through holes (not shown) in the shroud 18 and also through the spanwise row of closely spaced small holes 24 in the trailing edge 26 of the aerofoil.

Others of the internal passages are connected to another cooling air entry port (not shown) located at the base 27 of the "fir-tree" root portion 12, where high pressure cooling air enters and cools the internal surfaces of the aerofoil 16 by its circulation through the passages and eventual exit through holes (not shown) in the shroud 18. It is also utilised to film-cool the external surface of the flank 28 of the aerofoil 16 by means of spanwise extending rows of film cooling holes 30 to 33.

Figure 2A:
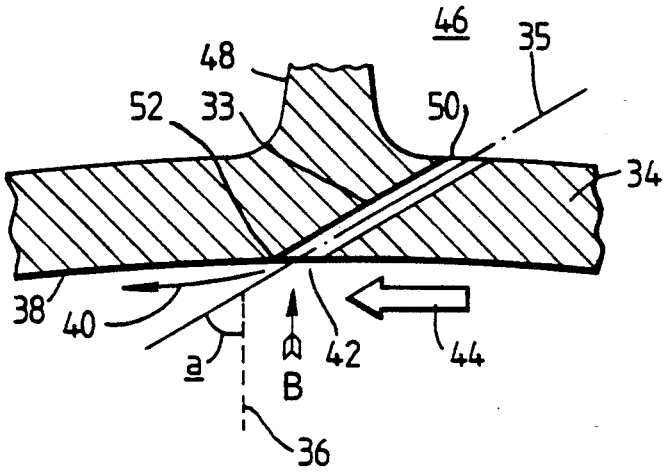
Fig. 2A PRIOR ART
FIG. 2A is a longitudinal cross-section through a prior art film cooling hole.
Figure 2B:
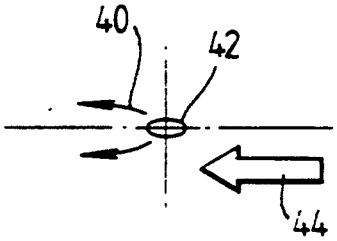
FIG. 2B is a plan view on arrow B in FIG. 2A showing the shape of the prior art film cooling hole's exit aperture.

FIG. 2 shows a typical cross-section through the wall 34 of the blade 10 in the region of the row of film cooling holes 33, one of the holes 33 being seen in longitudinal cross-section. The hole 33 penetrates the wall thickness at an angle a of the hole's longitudinal centerline 35 with respect to a normal 36 to the exterior surface 38 of the aerofoil in that region. This measure ensures a less turbulent exit of the stream of cooling air 40 from the hole's exit aperture 42 onto the surface 38, because the stream of cooling air is thereby given a component of velocity in the direction of the flow of hot turbine gases 44 over the surface 38. The film cooling air 40 is as previously mentioned taken from one of the internal passages 46, shown partially bounded by the wall 34 and an internal partition 48. The shape of the exit aperture 42 is of course elliptical.

When gas turbine engines are operated in certain arid areas of the world, primarily the Middle East, very fine dust particles, prevalent in the first few tens of meters above ground level and on occasions present at altitudes of thousands of meters, can enter the engine's cooling air system by way of the engine's compressor and pass into the interior of the turbine blades or other cooled blades or vanes. When cooling air flowing along the surface of an internal cooling passage such as 46 encounters the entry aperture 50 of a hole 33, some of the cooling air flows into the hole and the edges of the entry aperture 50 generate vortices in the flow. Fine particles are separated from the main flows of air through the passage 46 or through the hole 33 and are deposited in the low velocity regions near the edges, where some of the minerals in the dust particles are heated to temperatures near or at melting point, rendering at least some of the particles tacky or plastically deformable and liable to stick to each other and to the metallic surface. At these points the deposits grow, and the entry aperture 50 slowly becomes blocked.

Regarding blockage of the exit aperture 42, the deposits tend to build up on the downstream edge 52 of the hole. Build-up here is more likely to be due to the passing particles in the main turbine gas flow 44 experiencing the edge 52 as a step in spite of the angling of the hole 33 at angle a, the flow therefore becoming detached from the surface at this point and forming a vortex. This is more likely to be the case when the cooling hole is not blowing hard, i.e. when the pressure drop between passage 46 and the external surface 38 of the blade is small. However, for higher pressure drops and consequently greater blowing rates, the flow 44 meeting cooling air stream 40 will produce a local vortex and this will deposit particles in a similar manner. Either way the deposits grow towards the opposite edge of the exit aperture 42 and eventually block the hole.

Figure 3A:
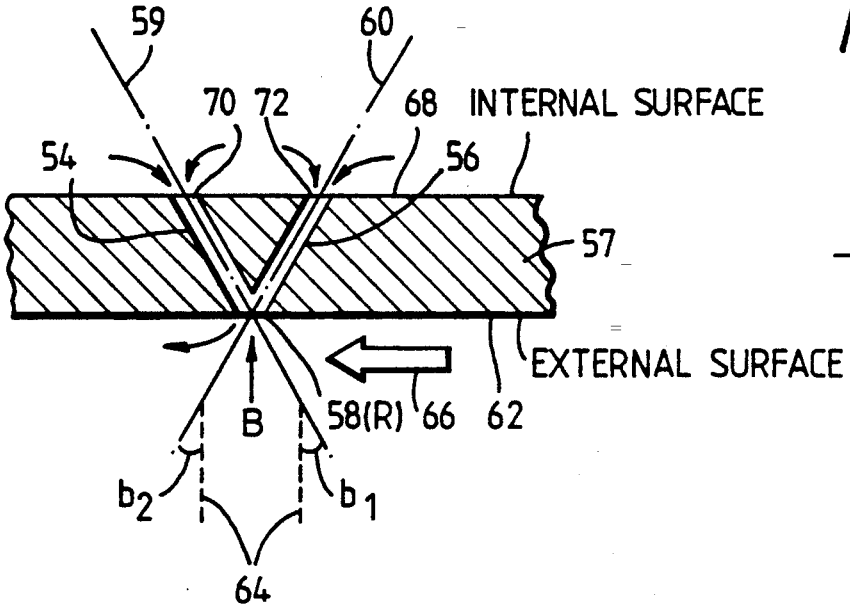
FIG. 3A is a similar cross-section through a film cooling hole configuration in accordance with the invention.
Figure 3B:
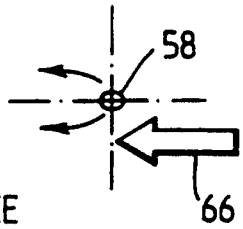
FIG. 3B is a plan view on arrow B in FIG. 3A showing the shape of the film hole's exit aperture.

It is often the internal blockage that is most troublesome to the operator of the engine because it can build up more quickly and also is not easily accessible to abrasive cleaners and the like. FIGS. 3A and 3B illustrate how this problem can be significantly eased according to the invention by drilling two intersecting holes 54 and 56 through a wall 57, instead of the single hole 33 shown in FIG. 2. The holes 54 and 56 have a common exit aperture 58. The centerlines 59 and 60 of the holes 54 and 56 occupy a common plane perpendicular to the external surface 62 of the wall 57, but make angles $b_1$ and $b_2$ with normals 64 to the external surface. Angles $b_1$ and $b_2$ may or may not be numerically identical, but they are on opposing sides of the normals 64, angle $b_1$ causing the hole 54 to trend counter to the direction of the flow 66 over the external surface, and angle $b_2$ causing the hole 56 to trend with the flow 66. Assuming angles $b_1$ and $b_2$ are identical, the holes are therefore of opposing orientation but the same obliquity with respect to the exterior surface 62. It should be particularly noted that the common exit aperture 58 is elliptical, this being achieved by drilling the holes 54 and 56 with their centerlines passing through a common point in the external surface 62 and making angles $b_1$ and $b_2$ equal. The aperture 58 is the controlling restrictor, acting as a metering orifice or throttle point for the flows of cooling air entering both holes on the internal surface 68 of the wall 57. To obtain the same consumption of air as prior art holes, the aperture 58 can be made the same area as the single hole which the two holes 54 and 56 replace, hence the velocities of the cooling air flows into the two entry apertures 70 and 72 will be lower than for a single hole and the rate of internal blockage will be slowed because of reduced vorticity at entry.

Although in FIG. 3, the plane containing the centerlines 59,60 of the holes 54,46 is oriented to be parallel with the direction of the turbine gas flow 66 over the surface 62, it would of course be possible to drill the holes so that the same plane is oriented transversely of flow 66. In this case, the major axis of elliptical aperture 58 would also be oriented transversely of flow 66.

As mentioned previously, holes with enlarged exit apertures may be required in order to help the stream of film cooling air to spread out as it emerges from the exit aperture and/or to lengthen the time it takes the hole to block up. A way of achieving such an enlargement of a common exit aperture for two or more separately drilled holes is shown in FIG. 4.

Figure 4A:
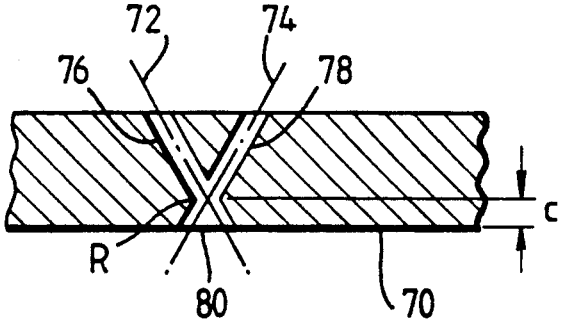
Figure 4B:
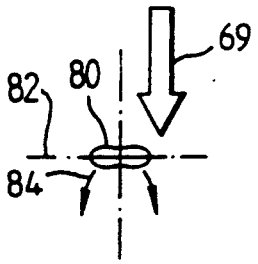

In FIG. 4A, it is assumed that the flow of turbine gases 69 (FIG. 4B) over the external surface 70 is approximately perpendicular to the plane of the paper, but the centerlines of the two intersecting holes 76,78 make the same angles with normals to the surface 70 as did the holes 54,46 with the normals 64 in FIG. 3A. However, because the point of intersection of the centrelines 72,74 is a certain distance c behind the external surface 70, the common exit aperture 80 of the holes 76,78 is not elliptical in plane view, but comprises twin overlapping ellipses, making a twin-lobed or "dumbell" oval shape (FIG. 4B). The exit aperture 80 is thereby enlarged with respect to aperture 58 in FIG. 3, the enlargement being on an axis 82 transverse to the turbine gas flow 69 so that the stream of cooling air 84 is spread more evenly over the surface 70 downstream of the aperture 80. The controlling restriction R for the flow of cooling air 84 is at the intersection of the two holes, within the wall thickness.

Figure 5A:
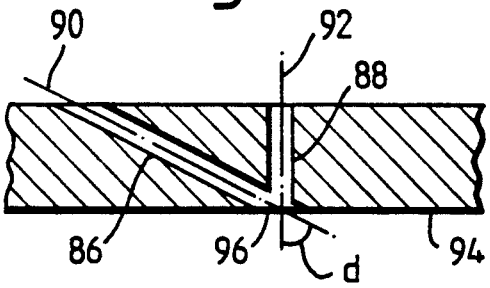
Figure 5B:
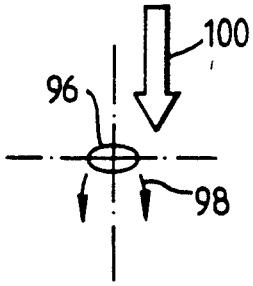

In FIG. 5, two intersecting holes 86,88 are again drilled, their centrelines 90,92 intersecting—as in FIG. 3A—at a point in the plane of the exterior surface 94. However, unlike FIG. 3A, one of holes 88 is drilled normal to the surface 94, the other hole 86 being drilled into surface 94 at a pronouncedly oblique angle. The length of the major axis of the resulting elliptical shape of the common exit aperture 96 (FIG. 5B) is dictated by the obliquity of the hole 86, i.e. by the size of angle d made by its centerline 90 with a normal to the surface 94. Plainly, the exit aperture 96 is the controlling restriction for the flow of cooling air through the two holes. Once again, to enable maximum spread of the cooling air 98 over the surface 94 downstream of the aperture 96, the major axis of the aperture is oriented across the direction of the turbine gas flow 100.

Figure 6A:
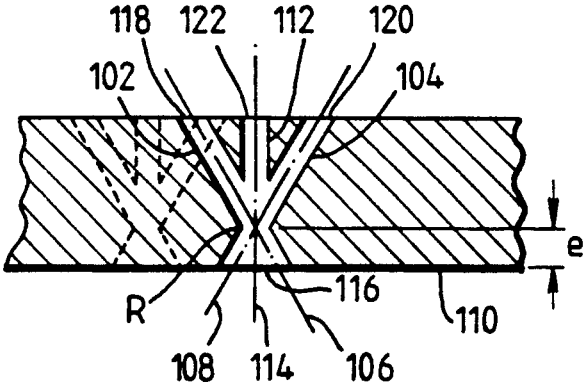
Figure 6B:
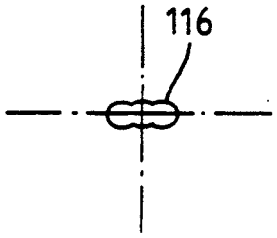

FIG. 6 shows a cooling hole configuration similar to that of FIG. 4, in that it has two intersecting cooling holes 102,104 of equal but opposing obliquity, the intersection of their centerlines 106,108 being at a distance behind the external surface 110. However it also has a third cooling hole, 112, drilled normal to the surface 110, whose centerline 114 passes through the same point of intersection as the other two centerlines 106,108 to help form the internal flow restriction R, which for holes of equal diameter and obliquity is approximately the same area as for the embodiment of FIG. 4A. It will be seen that the resulting exit aperture 116 is substantially elliptical in shape, but has a longer major axis than aperture 80 in FIG. 4 because distance e is greater than distance c. The presence of the third hole 112 ensures that the velocities of the cooling air flows into the three entry apertures 118,120,122 will be even lower than for two holes, thus further reducing vorticity and increasing the time taken for internal blockage to occur. It also substantially removes or reduces the "dumbell" effect of the two overlapping ellipses caused by penetration of the exterior surface 110 by the oblique holes 102,104. Orientation of the exit aperture 116 with respect to the direction of the main turbine gas flow over the surface 110 is again preferably transverse.

Figure 7:
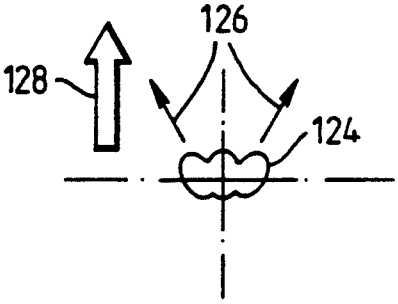
FIG. 7 is a plan view showing a further alternative shape for the exit aperture of a film cooling hole.

In the preceding embodiments, the longitudinal centerlines of the various holes illustrated have, for each embodiment, occupied a common plane perpendicular to the external wall surfaces. FIG. 7 shows the shape of the exit aperture 124 produced by rotating the common plane containing the center-lines of holes 102,104,112 in FIG. 6 about its line of contact with the external wall surface 110 so that the entry aperture ends of the holes move away from the viewer. It can be seen that the effect is to enhance the lobed shape of the aperture in such a way that the two outer lobes, being ellipses produced by holes 102,104, have major axes which are splayed away from each other. This is again advantageous in enlarging the aperture against blockage and also encouraging the emergent stream of film cooling air 126 to fan out downstream of the aperture, the direction of flow of the hot turbine stream 128 being as shown.

Plainly, besides the ones shown, various other film cooling hole configurations, involving two or more cooling holes sharing a common air metering restriction and exit aperture, are possible. The holes may be drilled at any inclinations of choice with respect to the external wall surface of the component and may intersect at any desired position in or behind the surface, according to the shape of exit aperture required. It is not necessary for the centerlines of the holes to intersect each other exactly, or to intersect at exactly the same point, provided a suitable air flow throttling restriction is formed in or behind the external wall surface.

A further point of interest, illustrated in connection with FIG. 6A but applicable to all the configurations shown, is that if adjacent exit apertures 116 are required to be closely spaced, it is possible for adjacent obliquely drilled holes 102,104, associated with different exit apertures, to intersect each other at or near the interior wall surface, this being shown in dashed lines. The principle of the invention with respect to the formation of exit apertures is not thereby changed, but it is thereby possible to create enlarged entry apertures for some of the holes, if desired. This assumes good machining accuracy. To avoid such intersection of holes belonging to different exit apertures, it would of course be possible to alter their orientations slightly with respect to each other.

Turning now to the manufacture of the cooling hole configurations, several methods are available, as follows.

Electro-discharge or spark-erosion machining (EDM) uses cylindrical wire electrodes to drill through the workpiece using a low-voltage, high current power source connected across the workpiece and electrode. Holes of upwards of about 0.22 mm diameter can be produced. It is a slow process, but it is possible to drill several holes simultaneously, provided they are mutually parallel.

Capillary drilling is an alternative chemical machining process described in British Patent Number 1348480 and assigned to Rolls-Royce. An inert (non-consumable) electrode in the form of a fine wire is surrounded by a concentric glass capillary tube. An electrolyte is passed down the annular gap between electrode and tube and material is removed from the workpiece when a voltage is applied across the electrode and the workpiece. Its capabilities are similar to EDM.

In laser machining, a pulsed beam of high energy laser light is focused onto the workpiece surface, causing the material at the focus to absorb energy until vaporized and removed from the workpiece. Through holes can be drilled by constantly adjusting the focus of the beam as material is removed to keep the hole the same diameter. Holes with diameters upwards of about 0.25 mm can be drilled in this way either by keeping the beam stationary, or by trepanning. In the latter process, the laser beam is passed through an optical system which makes the beam move round the periphery of a cylinder of small diameter related to the size of hole it is desired to drill. In this way the laser beam cuts out the hole around its edge. Surface finish of the hole is better by the latter method.

Insofar as drilling film cooling holes in turbine blades are concerned, lasers are several times faster per hole produced than the other two processes mentioned above.

The present invention has significant advantages in terms of use of the above three processes for producing film cooling holes with enlarged exit apertures suitable for delaying blockage and facilitating production of a continuous cooling air film by merging of divergent adjacent streams.

Known ways of utilizing the EDM to produce enlarged exit apertures involve standard cylindrical wire electrodes which are oscillated as appropriate for the shape of a aperture required, the amplitude of oscillation decreasing towards the bottom of the aperture Clearly, this is even slower than the standard EDM process. Alternatively, electrodes are used which are the same shape as the required hole, the electrodes being traversed linearly into the wall. Once again, the process is slow. Furthermore, the shaped electrodes are themselves expensive to manufacture and can only be used once. However, it will be realized that the present invention avoids the above complications and allows the use of the standard EDM process to produce enlarged exit apertures.

Before the present invention it does not seem to have been known to produce enlarged exit apertures by the capillary drilling process, but it is clearly possible with the present invention.

The present invention also makes possible the use of laser drilling techniques—either "straight-through" or trepanning—to quickly produce enlarged exit apertures of many different shapes and sizes.

Although the above specific embodiments have focused on the production of various film cooling hole configurations in the aerofoil portions of stator vanes or rotor blades, such configurations can also be utilised to cool the shrouds or platforms of these devices, or indeed for other surfaces in the engine requiring film cooling.

While specific reference has been made only to air-cooled turbomachinery components, other fluids may also be utilised to film-cool surfaces exposed to intense heat, and the ambit of the invention does not exclude them.

I claim:

1. A film-cooled component having wall means comprising a first surface subject to heating by flow of hot fluid therepast and a second surface subjected to cooling by flow of pressurized coolant therepast, the first surface having a plurality of small coolant exit apertures therein connected to the second surface by cooling hole structures extending through the wall means, whereby coolant exits from said apertures onto the first surface for film-cooling of the same, each cooling hole structure comprising in flow series a plurality of coolant entry apertures in said second surface, a flow constriction and one of said exit apertures connected only to said one flow constriction, each cooling hole structure being a plurality of substantially straight mutually intersecting holes which share said flow constriction and said exit aperture, each cooling hole structure being separated by a portion of said wall means from each other cooling hole structure so that said cooling hole structures are unconnected to one another, said flow constriction comprising the intersection of said holes and said exit aperture being formed adjacent said intersection, said flow constriction being of smaller flow are than said exit aperture.

2. A film-cooled component according to claim 1, in which each exit aperture is connected to the second surface by two mutually intersecting holes.

3. A film-cooled component according to claim 1, in which each exit aperture is connected to the second surface by three mutually intersecting holes.

4. A film-cooled component according to claim 1 in which the longitudinal centerlines of the intersecting holes intersect at a common point.

5. A film-cooled component according to claim 1 in which each hole has substantially similar obliquity with respect to the first surface.

6. A film-cooled component according to claim 1 in which the holes have unequal obliquities with respect to the first surface.

7. A film-cooled component according to claim 1 in which the longitudinal centerlines of the holes occupy a single plane.

8. A film-cooled component according to claim 7 in which the single plane containing the longitudinal centerlines is obliquely oriented with respect to the first surface.

9. A film-cooled component according to claim 1 comprising a turbine aerofoil for a gas turbine engine.

10. A method for producing a film-cooled component, the component having wall means comprising a first surface subject to heating by flow of hot fluid therepast and a second surface subject to cooling by flow of pressurized coolant therepast, the method comprising drilling a plurality of groups of film-cooling holes through the wall means to connect the first surface to the second surface, the members of each group of holes being drilled sequentially with different but crossing orientation with respect to each other such that they penetrate the first surface in overlapping fashion to form a common coolant exit aperture and intersect each other to form a flow constriction for controlling the flow rate of coolant out of the common exit aperture, said flow constriction being of smaller flow area than said exit aperture, and including the step of maintaining the members of each group having a common coolant exit aperture separated from the members of each other group associated with a different exit aperture.

11. A method according to claim 10 in which two holes are drilled to form each exit aperture.

12. A method according to claim 10 in which three holes are drilled to form each exit aperture.

13. A film-cooled component produced by the method of claim 10.

* * * * *